US007219604B2

(12) United States Patent
Hoffman et al.

(10) Patent No.: US 7,219,604 B2
(45) Date of Patent: May 22, 2007

(54) TRANSFER BLANKET, IN PARTICULAR RUBBER BLANKET, FOR A PRINTING PRESS

(75) Inventors: Eduard Hoffman, Bobingen (DE); Georg Schmid, Nuesäss (DE)

(73) Assignee: MAN Roland Druckmaschinen, Augsburg (DE)

( * ) Notice: Subject to any disclaimer, the term of this patent is extended or adjusted under 35 U.S.C. 154(b) by 0 days.

(21) Appl. No.: 11/117,532

(22) Filed: Apr. 29, 2005

(65) Prior Publication Data

US 2005/0241503 A1 Nov. 3, 2005

(30) Foreign Application Priority Data

Apr. 30, 2004 (DE) ..... 10 2004 021 498

(51) Int. Cl.

| | |
|---|---|
| ***B41F 13/10*** | (2006.01) |
| ***B41F 27/06*** | (2006.01) |
| ***B41N 10/02*** | (2006.01) |
| ***B41N 10/04*** | (2006.01) |
| ***B41N 10/06*** | (2006.01) |

(52) U.S. Cl. ..... 101/376; 101/375; 101/217

(58) Field of Classification Search ..... None
See application file for complete search history.

(56) References Cited

U.S. PATENT DOCUMENTS

| | | | | |
|---|---|---|---|---|
| 3,730,092 | A * | 5/1973 | Pickard et al. | 101/415.1 |
| 4,537,129 | A * | 8/1985 | Heinemann et al. | 101/415.1 |
| 5,934,194 | A | 8/1999 | Puschnerat et al. | |
| 6,530,321 | B2 | 3/2003 | Andrew et al. | |
| 6,640,705 | B1 * | 11/2003 | Stuhlmiller et al. | 101/217 |
| 6,645,601 | B1 | 11/2003 | Serain et al. | |

FOREIGN PATENT DOCUMENTS

| | | | |
|---|---|---|---|
| DE | 4320464 | * | 12/1994 |
| DE | 44 00 202 A 1 | | 8/1995 |
| DE | 195 43 584 C 1 | | 7/1997 |
| DE | 10117409 | * | 10/2002 |
| EP | 1 543 987 A1 | | 6/2005 |
| EP | 1 543 988 A1 | | 6/2005 |
| WO | WO 2005/047011 A1 | | 5/2005 |

* cited by examiner

*Primary Examiner*—Daniel J. Colilla
*Assistant Examiner*—Marissa Ferguson-Samreth
(74) *Attorney, Agent, or Firm*—24IP Law Group USA; Timothy R. DeWitt

(57) ABSTRACT

The transfer blanket (10), in particular a rubber blanket, for a printing press, has a carrier layer (11), a covering layer (12) and at least one intermediate layer (13, 14, 15) which is positioned between the carrier layer and the covering layer, the carrier layer protruding, compared with at least one intermediate layer, at at least one end of the transfer blanket (10), using which end the said transfer blanket (10) can be fastened at a clamping point (17) of a printing press, and ends of the or each intermediate layer, which are of shortened configuration compared with the carrier layer (11), being sealed with the aid of a sealing layer (16). The sealing layer (16) extends over the carrier layer (11) in such a way that the transfer blanket can be fastened at the clamping point of the printing press at least via the carrier layer and the sealing layer.

18 Claims, 3 Drawing Sheets

TRANSFER BLANKET, IN PARTICULAR RUBBER BLANKET, FOR A PRINTING PRESS

CROSS-REFERENCE TO RELATED APPLICATIONS

This application claims priority under 35 U.S.C. § 119 to German application number 10 2004 021 498.0, filed 30 Apr.2004, the entirety of which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The invention relates to a transfer blanket, in particular a rubber blanket, for a printing press.

2. Brief Description of the Related Art

In offset printing, it is conventional practice to transfer ink from a printing plate onto a printing material along an indirect path via a transfer blanket which is also called a rubber blanket. Here, a distinction is made between compressible and non-compressible rubber blankets, compressible rubber blankets optionally being used. Rubber blankets are able to compensate for unevennesses in the printing material at the printing locations. As rubber blankets of this type can age and be damaged with regard to their physical and chemical properties, they have to be exchangeable. For this purpose, the rubber blankets are fastened at clamping points within the printing press, it being intended for the clamping point to have dimensions which are as small as possible, for reasons of the printing quality. Here, it can be difficult to fasten the rubber blankets at a clamping point with correspondingly small dimensions.

U.S. Pat. No. 6,530,321 B2 discloses a rubber blanket for a printing press, having a carrier layer and a covering layer, a plurality of intermediate layers being arranged between the carrier layer and the covering layer. According to U.S. Pat. No. 6,530,321 B2, all of the intermediate layers and the covering layer are shortened compared with the carrier layer. The rubber blanket is then fastened at a clamping point of the printing press exclusively using the carrier layer.

DE 195 43 584 C1 likewise discloses a rubber blanket for a printing press. The rubber blanket disclosed in DE 195 43 584 C1 again has a carrier layer, a covering layer and a plurality of intermediate layers which are positioned between the carrier layer and the covering layer. All of the intermediate layers are of shortened configuration compared with the carrier layer, that section of the carrier layer which protrudes compared with the intermediate layers being of angled-away configuration. The rubber blanket is fastened at the clamping point of the printing press exclusively via this angled-away section of the carrier layer. The free ends of the intermediate layers are sealed via an angled-away portion of the covering layer.

Accordingly, a common feature of the transfer blankets or rubber blankets known from the prior art is that they are fastened at the clamping point of the printing press exclusively via the carrier layer.

SUMMARY OF THE INVENTION

Proceeding from the foregoing, one aspect of the present invention includes providing a novel transfer blanket, in particular a rubber blanket, for a printing press.

According to another aspect of the present invention, the sealing layer extends over the carrier layer in such a way that the transfer blanket can be fastened at the clamping point of the printing press at least via the carrier layer and the sealing layer.

According to another aspect of the invention, a transfer blanket useful for a printing press comprises a carrier layer, a sealing layer, a covering layer, and at least one intermediate layer positioned between the carrier layer and the covering layer, the carrier layer protruding, compared with the at least one intermediate layer, at at least one end of the transfer blanket, using the at least one end the transfer blanket can be fastened at a clamping point of a printing press, wherein at least one of the at least one intermediate layer comprises shortened ends compared with the carrier layer, the shortened ends being sealed with the sealing layer, and wherein the sealing layer extends over the carrier layer so that the transfer blanket can be fastened at the clamping point of the printing press at least via the carrier layer and the sealing layer.

According to another aspect of the invention, the covering layer comprises the sealing layer.

According to another aspect of the invention, the sealing layer comprises a separate layer.

According to another aspect of the invention, each of the at least one intermediate layer is shortened compared with the carrier layer and the covering layer, the covering layer comprising the sealing layer, and the carrier layer and the covering layer being configured and arranged to permit exclusive fastening of the transfer blanket at the clamping point of the printing press.

According to another aspect of the invention, at least one of the at least one intermediate layer is shortened compared with the carrier layer and the covering layer, the covering layer comprising the sealing layer, and the carrier layer, the covering layer, and an intermediate layer which immediately adjoins the covering layer being configured and arranged to permit fastening of the transfer blanket at the clamping point of the printing press.

According to another aspect of the invention, at least one of the at least one intermediate layer tapers toward the clamping point, the covering layer comprising the sealing layer, and the carrier layer and the covering layer are configured and arranged to permit fastening of the transfer blanket at the clamping point.

According to another aspect of the invention, at least one of the at least one intermediate layer is shortened compared with the carrier layer and the covering layer, the sealing layer comprising a separate layer, and the carrier layer, the sealing layer, and an intermediate layer which immediately adjoins the carrier layer are configured and arranged to permit fastening of the transfer blanket at the clamping point of the printing press.

According to another aspect of the invention, a transfer blanket useful for a printing press comprises a carrier layer, a sealing layer, a covering layer, wherein the carrier layer protrudes, compared with the covering layer, at at least one end of the transfer blanket, the transfer blanket configured and arranged to be fastened at a clamping point of a printing press with the at least one end, wherein the covering layer comprises one end which is shortened compared with the carrier layer, the one end being sealed with the sealing layer, and wherein the sealing layer extends over the carrier layer so that the transfer blanket can be fastened at the clamping point of the printing press at least via the carrier layer and the sealing layer.

According to another aspect of the invention, a transfer blanket useful for a printing press comprises a carrier layer, a covering layer, and at least one intermediate layer positioned between the carrier layer and the covering layer, wherein at least one of the at least one intermediate layer tapers toward a clamping point.

According to another aspect of the invention, the transfer blanket comprises a rubber transfer blanket.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

Preferred or exemplary embodiments of the invention are explained in greater detail, without being restricted thereto, using the drawing, in which.

DETAILED DESCRIPTION OF PREFERRED EMBODIMENTS

Figure 1:
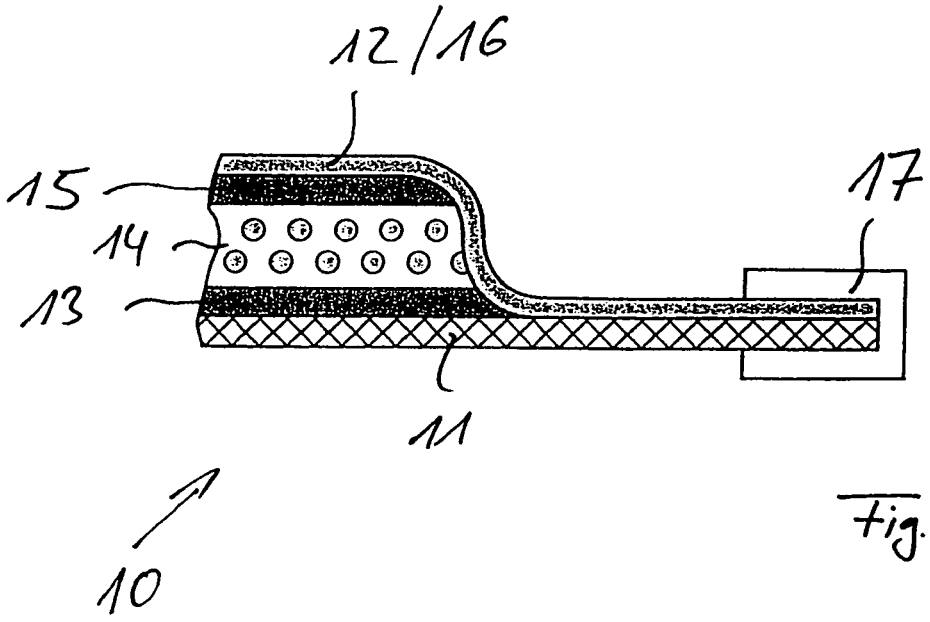
FIG. 1: shows a diagrammatic cross section through a transfer blanket according to the invention, that is to say a rubber blanket, for a printing press, according to a first exemplary embodiment of the present invention.

Referring to the drawing figures, like reference numerals designate identical or corresponding elements throughout the several figures.

In the following text, the present invention will be described in greater detail with reference to FIGS. 1 to 5.

FIG. 1 shows a first exemplary embodiment of a transfer blanket according to the invention, which will be denoted rubber blanket 10 in the following text. The rubber blanket 10 of the exemplary embodiment of FIG. 1 is of multi-ply or multi-layer configuration and has a carrier layer 11, a covering layer 12 and, in the exemplary embodiment of FIG. 1, three intermediate layers 13, 14 and 15. A first intermediate layer 13 immediately adjoins the carrier layer 11 and is configured as a woven fabric layer. A second intermediate layer 15 immediately adjoins the covering layer 12 and is configured as a woven fabric layer, like the first intermediate layer 13. A third intermediate layer 14 which is configured as a compressible layer is arranged between the first intermediate layer 13 and the second intermediate layer 15. In the exemplary embodiment of FIG. 1, all of the intermediate layers 13, 14 and 15 are of shortened configuration compared with the carrier layer 11. Ends of the intermediate layers 13, 14 and 15 of shortened configuration are sealed by a sealing layer, the covering layer 12 directly forming the sealing layer 16 in the exemplary embodiment of FIG. 1. Here, the sealing layer 16 or the covering layer 12 extends over the carrier layer 11 in such a way that the rubber blanket 10 can be fastened at a clamping point 17 of a printing press (not shown in greater detail) via the carrier layer 11 and the covering layer 12, and thus the sealing layer 16.

Figure 2:
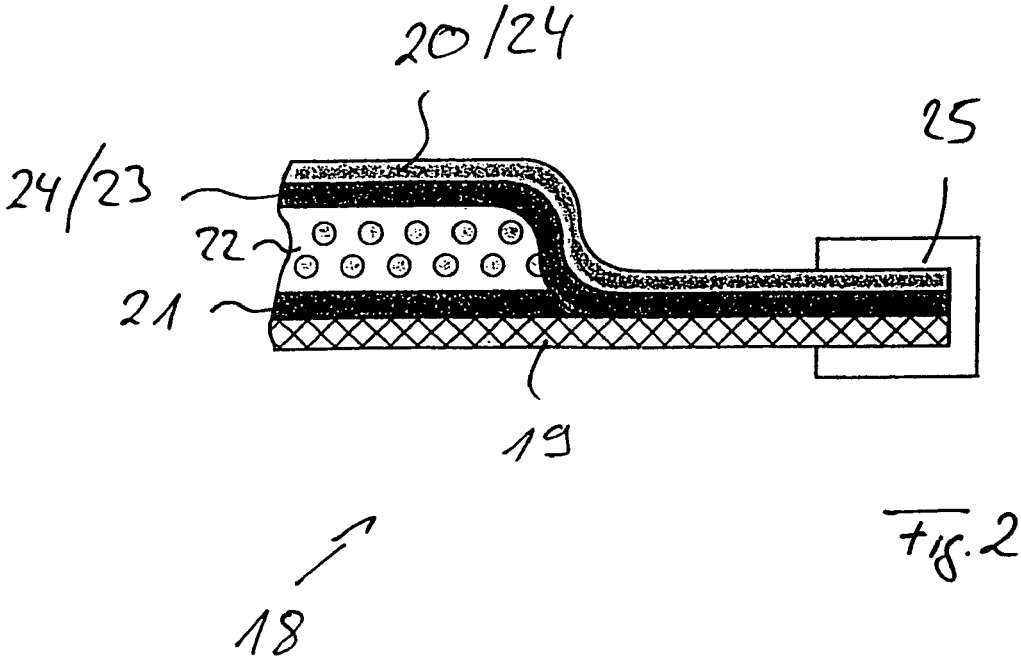
FIG. 2: shows a diagrammatic cross section through a transfer blanket according to the invention, that is to say a rubber blanket, for a printing press, according to a second exemplary embodiment of the present invention.

FIG. 2 shows a further exemplary embodiment of a rubber blanket 18 according to the invention. The rubber blanket 18 of FIG. 2 is again of multi-ply or multi-layer configuration, and it has a carrier layer 19, a covering layer 20 and a total of three intermediate layers 21, 22 and 23. The intermediate layers 21, 22 and 23 of the exemplary embodiment of FIG. 2 correspond to the intermediate layers 13, 14 and 15 of the exemplary embodiment of FIG. 1, so that reference can be made to the above comments. The exemplary embodiment of FIG. 2 differs from the exemplary embodiment of FIG. 1 in that, in the exemplary embodiment of FIG. 2, only the intermediate layers 21 and 22 are of shortened configuration compared with the carrier layer 19. In the exemplary embodiment of FIG. 2, the intermediate layer 23 which immediately adjoins the covering layer 20 extends over the region of the carrier layer 19, in the same way as the covering layer 20, the intermediate layer 23 and the covering layer 20 in the exemplary embodiment of FIG. 2 forming the sealing layer 24 for the intermediate layers 21 and 22 of shortened configuration. In the exemplary embodiment of FIG. 2, the rubber blanket 18 is accordingly fastened in a clamping point 25 of a printing press via the carrier layer 19 and the sealing layer 24, the sealing layer 24 being formed by the covering layer 20 and the intermediate layer 23.

Figure 3:
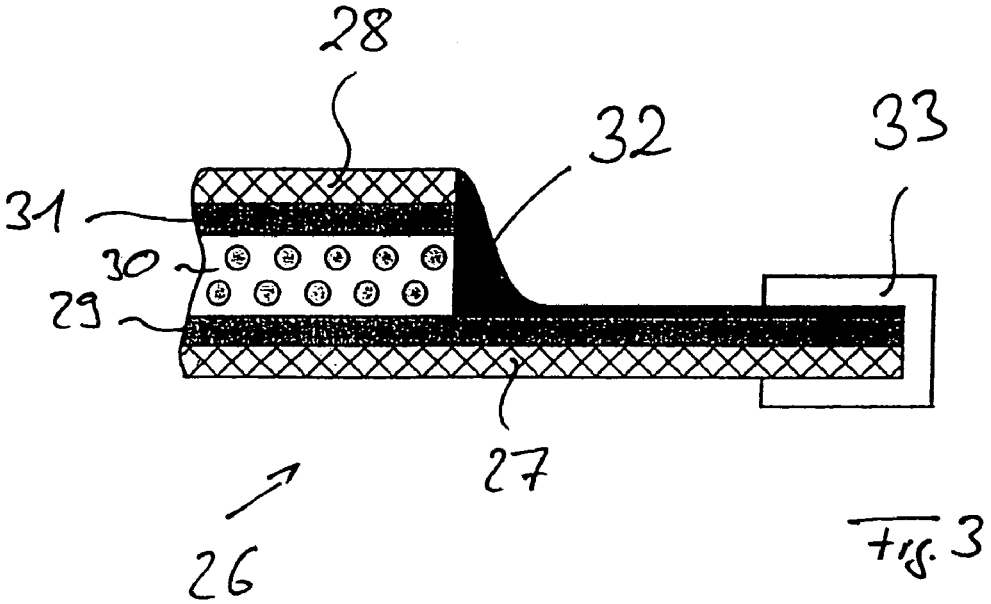
FIG. 3: shows a diagrammatic cross section through a transfer blanket according to the invention, that is to say a rubber blanket, for a printing press, according to a third exemplary embodiment of the present invention.

FIG. 3 shows a further exemplary embodiment of a rubber blanket 26 according to the invention. The rubber blanket 26 of FIG. 3 is again of multi-ply or multi-layer configuration and has a carrier layer 27, a covering layer 28 and three intermediate layers 29, 30 and 31. In the exemplary embodiment of FIG. 3, the intermediate layers 30 and 31 and the covering layer 28 are of shortened configuration compared with the carrier layer 27 and the intermediate layer 29, the intermediate layer 29 of non-shortened configuration immediately adjoining the carrier layer 27. In the exemplary embodiment of FIG. 3, there is a sealing layer 32 which is configured as a separate layer and which firstly seals the shortened ends of the two intermediate layers 30 and 31 and the shortened end of the covering layer 28, and which secondly extends over the carrier layer 27 and the intermediate layer 29 in such a way that the rubber blanket 26 of FIG. 3 is fastened in a clamping point 33 of the printing press via the carrier layer 27, the intermediate layer 29 and the sealing layer 32.

Figure 4:
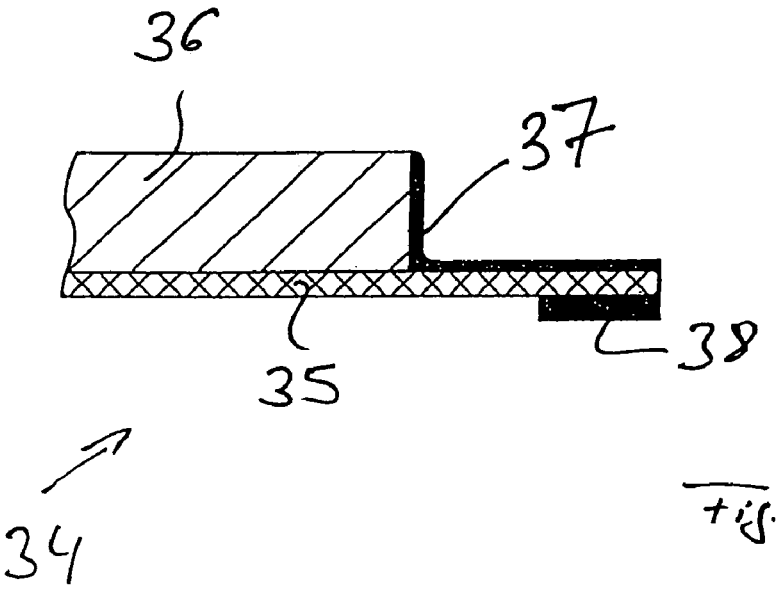
FIG. 4: shows a diagrammatic cross section through a transfer blanket according to the invention, that is to say a rubber blanket, for a printing press, according to a fourth exemplary embodiment of the present invention.

FIG. 4 shows a further exemplary embodiment of a rubber blanket 34 according to the invention. The rubber blanket of FIG. 4 has a two-ply or two-layer construction comprising a carrier layer 35 and a covering layer 36. The covering layer 36 is of shortened configuration compared with the carrier layer 35, one shortened end of the covering layer 36 being sealed via a sealing layer 37 which is configured as a separate layer. The sealing layer 37 extends once again over the carrier layer 35 in such a way that the rubber blanket 34 can be fastened at a clamping point 38 of a printing press via the carrier layer 35 and the sealing layer 37.

Figure 5:
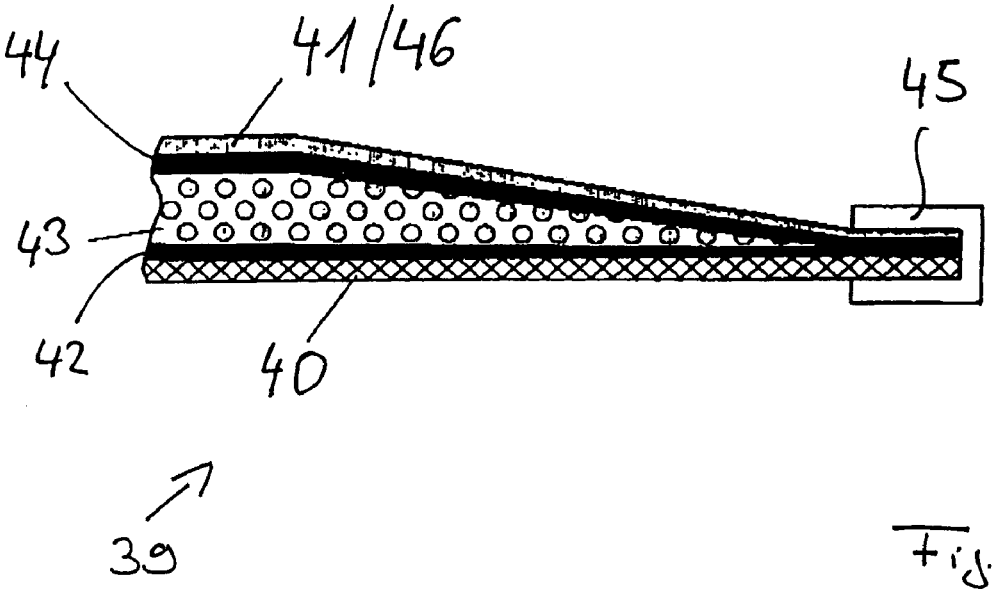
FIG. 5: shows a diagrammatic cross section through a transfer blanket according to the invention, that is to say a rubber blanket, for a printing press, according to a fifth exemplary embodiment of the present invention.

FIG. 5 shows a further exemplary embodiment of a rubber blanket 39 according to the invention. The rubber blanket 39 of FIG. 5 is of multi-ply or multi-layer construction, and it has a carrier layer 40, a covering layer 41 and a total of three intermediate layers 42, 43 and 44. The intermediate layers 42, 43 and 44 of the exemplary embodiment of FIG. 5 correspond to the intermediate layers 13, 14 and 15 of the exemplary embodiment of FIG. 1, so that reference can be made to the above comments.

In the exemplary embodiment of FIG. 5, the intermediate layer 43 tapers in the direction of a clamping point 45. In the same way as the covering layer 41 and the intermediate layer 42 which immediately adjoins the carrier layer 40, the intermediate layer 44 which immediately adjoins the covering layer 41 extends over the region of the carrier layer 40, the intermediate layer 44 and the covering layer 41 in the exemplary embodiment of FIG. 5 forming the sealing layer 46 for the shortened and tapered intermediate layer 43. In the exemplary embodiment of FIG. 5, the rubber blanket 39 is accordingly fastened in the clamping point 45 of a printing press via the carrier layer 40, the intermediate layer 42 and the sealing layer 46, the sealing layer 46 being formed by the covering layer 41 and the intermediate layer 44.

The intermediate layer 43 of the exemplary embodiment of FIG. 5 is tapered by mechanical, thermal and/or chemical processes. The intermediate layer 43 is accordingly compressed or eroded in a tapering manner by the application of pressure, temperature and/or solvents.

Accordingly, a common feature of all of the exemplary embodiments according to FIGS. 1 to 5 is that the rubber blankets 10, 18, 26, 34 and 39 are fastened at a clamping point 17, 25, 33, 38 and 45, respectively, of a printing press via the carrier layer 11, 19, 27, 35 and 40, respectively, and the sealing layer 16, 24, 32, 47 and 46, respectively, at the clamping point. In addition, it is optionally possible for intermediate layers to be guided into the region of the clamping point. In the exemplary embodiments of FIGS. 1 to 3 and 5, the clamping points 17, 25 and 33 are configured with U-shaped cross sections. In the exemplary embodiment of FIG. 4, the clamping point 38 is of I-shaped design and engages beneath the carrier layer 35. However, the clamping point 38 can also engage above the sealing layer 37. Furthermore, the clamping points can be of L-shaped configuration.

The carrier layers 11, 19, 27,35 and 40 of the rubber blankets 10, 18, 26,34 and 39 of the exemplary embodiments according to FIGS. 1 to 5 can be composed of plastic or be of metallic configuration.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A transfer blanket useful for a printing press, the transfer blanket comprising:

a carrier layer;

a sealing layer;

a covering layer; and at least one intermediate layer positioned between the carrier layer and the covering layer, the carrier layer protruding, compared with the at least one intermediate layer, at least one end of the transfer blanket, using the at least one end the transfer blanket can be fastened at a clamping point of a printing press;

wherein at least one of the at least one intermediate layer comprises shortened ends compared with the carrier layer, the shortened ends being sealed with the sealing layer; and wherein the sealing layer extends over at least one of the at least one intermediate layers and the carrier layer so that the transfer blanket can be fastened at the clamping point of the printing press at least via the carrier layer and the sealing layer.

2. A transfer blanket according to claim 1, wherein the covering layer comprises the sealing layer.

3. A transfer blanket according to claim 1, wherein the sealing layer comprises a layer separate from said covering layer.

4. A transfer blanket according to claim 1, wherein each of the at least one intermediate layer is shortened compared with the carrier layer and the covering layer, the covering layer comprising the sealing layer, and the carrier layer and the covering layer being configured and arranged to permit exclusive fastening of the transfer blanket at the clamping point of the printing press.

5. A transfer blanket according to claim 1, wherein at least one of the at least one intermediate layer is shortened compared with the carrier layer and the covering layer, the covering layer comprising the sealing layer, and the carrier layer, the covering layer, and an intermediate layer which immediately adjoins the covering layer being configured and arranged to permit fastening of the transfer blanket at the clamping point of the printing press.

6. A transfer blanket according to claim 1, wherein at least one of the at least one intermediate layer tapers toward the clamping point, the covering layer comprising the sealing layer, and the carrier layer and the covering layer are configured and arranged to permit fastening of the transfer blanket at the clamping point.

7. A transfer blanket according to claim 1, wherein at least one of the at least one intermediate layer is shortened compared with the carrier layer and the covering layer, the sealing layer comprising a separate layer, and the carrier layer, the sealing layer, and an intermediate layer which immediately adjoins the carrier layer are configured and arranged to permit fastening of the transfer blanket at the clamping point of the printing press.

8. A transfer blanket according to claim 1, comprising a rubber transfer blanket.

9. A transfer blanket useful for a printing press, the transfer blanket comprising:

a carrier layer;

a sealing layer;

a covering layer;

wherein the carrier layer protrudes, compared with the covering layer, at least one end of the transfer blanket, the transfer blanket configured and arranged to be fastened at a clamping point of a printing press with the at least one end;

wherein the covering layer comprises one end which is shortened compared with the carrier layer, the one end being sealed with the sealing layer; and wherein the sealing layer extends over the covering layer and the carrier layer so that the transfer blanket can be fastened at the clamping point of the printing press at least via the carrier layer and the sealing layer.

10. A transfer blanket according to claim 9, wherein the sealing layer comprises a separate layer.

11. A transfer blanket according to claim 9, comprising a rubber transfer blanket.

12. A transfer blanket useful for a printing press, the transfer blanket comprising:

a carrier layer;

a covering layer; and at least one intermediate layer positioned between the carrier layer and the covering layer;

wherein at least one of the at least one intermediate layer of the transfer blanket tapers toward a clamping point.

13. A transfer blanket according to claim 12, comprising a rubber transfer blanket.

14. A transfer blanket useful for a printing press, the transfer blanket comprising:

a carrier layer;

a covering layer; and first, second and third intermediate layers positioned between the carrier layer and the covering layer, the carrier layer extending beyond an end of at least one of said first, second and third intermediate layers at an end portion of the transfer blanket;

wherein the covering layer extends over the carrier layer at the end portion of the transfer blanket so that the transfer blanket can be fastened at a clamping point of the printing press at least via the carrier layer and a sealing layer and at least one of said covering layer and said first, second and third intermediate layers seals said end of at least one of said first, second and third intermediate layers.

15. A transfer blanket according to claim 14 wherein the carrier layer extends beyond an end of said second intermediate layer and said third intermediate layer seals said end of the second intermediate layer.

16. A transfer blanket according to claim 15 wherein said third intermediate layer comprises a sealing layer.

17. A transfer blanket according to claim 14 wherein the carrier layer extends beyond an end of said second intermediate layer and said covering layer seals said end of the second intermediate layer.

18. A transfer blanket useful for a printing press, the transfer blanket comprising:

a carrier layer;

a covering layer;

a sealing layer; and at least one intermediate layer positioned between the carrier layer and the covering layer, the carrier layer extending beyond an end of said at least one intermediate layer at an end portion of the transfer blanket;

wherein the sealing layer seals the end of the intermediate layer; and the sealing layer extends over the carrier layer at the end portion of the transfer blanket so that the transfer blanket can be fastened at the clamping point of the printing press at least via the carrier layer and the sealing layer.

* * * * *